US010755625B2

(12) United States Patent
Ishii et al.

(10) Patent No.: US 10,755,625 B2
(45) Date of Patent: Aug. 25, 2020

(54) LUMINANCE CONTROLLING UNIT, LIGHT-EMITTING UNIT, AND METHOD OF CONTROLLING LUMINANCE

(71) Applicant: JOLED Inc., Tokyo (JP)

(72) Inventors: Hiroaki Ishii, Tokyo (JP); Teppei Isobe, Tokyo (JP)

(73) Assignee: JOLED INC., Tokyo (JP)

( * ) Notice: Subject to any disclaimer, the term of this patent is extended or adjusted under 35 U.S.C. 154(b) by 72 days.

(21) Appl. No.: 16/049,010

(22) Filed: Jul. 30, 2018

(65) Prior Publication Data

US 2019/0051234 A1 Feb. 14, 2019

(30) Foreign Application Priority Data

Aug. 10, 2017 (JP) ..... 2017-155276

(51) Int. Cl.
*G09G 3/3208* (2016.01)

(52) U.S. Cl.
CPC ... *G09G 3/3208* (2013.01); *G09G 2320/0646* (2013.01); *G09G 2320/0653* (2013.01); *G09G 2330/021* (2013.01)

(58) Field of Classification Search
None
See application file for complete search history.

(56) References Cited

U.S. PATENT DOCUMENTS

2005/0212726 A1* 9/2005 Namba ..... G09G 3/22 345/63
2006/0127081 A1* 6/2006 Lee ..... G09G 3/3406 396/282
2009/0140665 A1* 6/2009 Park ..... H05B 45/10 315/291
2012/0139885 A1* 6/2012 Iwasa ..... G09G 3/3426 345/207
2014/0104305 A1* 4/2014 Ryu ..... G09G 3/3208 345/601
2016/0148576 A1* 5/2016 Kato ..... G09G 3/2007 345/211
2018/0082661 A1* 3/2018 Kang ..... G09G 5/10
2018/0247581 A1* 8/2018 Sakurai ..... G09G 3/36

FOREIGN PATENT DOCUMENTS

JP 2016-99468 A 5/2016

* cited by examiner

*Primary Examiner* — Kent W Chang
*Assistant Examiner* — Benjamin Morales
(74) *Attorney, Agent, or Firm* — Michael Best & Friedrich LLP

(57) ABSTRACT

A luminance controlling unit includes a luminance controller that controls luminance of a pixel array. The pixel array includes pixels each including a current-driven self-luminescent element. The luminescent controller sets, on the basis of an image signal corresponding to a frame image, a threshold that is directed to detection of a maximum signal level of the image signal, and performs dynamic control of a potential difference between a first voltage and a second voltage on the basis of the maximum signal level detected with reference to the set threshold. The first voltage is outputted from a first voltage source adjacent to an anode of the self-luminescent element, and the second voltage is outputted from a second voltage source adjacent to a cathode of the self-luminescent element.

19 Claims, 10 Drawing Sheets

LUMINANCE CONTROLLING UNIT, LIGHT-EMITTING UNIT, AND METHOD OF CONTROLLING LUMINANCE

CROSS REFERENCE TO RELATED APPLICATIONS

This application claims the benefit of Japanese Priority Patent Application No. 2017-155276 filed on Aug. 10, 2017, the entire contents of which are incorporated herein by reference.

BACKGROUND

The disclosure relates to a luminance controlling unit, a light-emitting unit, and a method of controlling luminance.

Recently, a display unit has been developed and commercialized that includes pixels each including a current-driven optical element, such as an organic electroluminescent element, in the technical field of an image display unit. The current-driven optical element changes its luminance depending on the magnitude of a current flowing therein. Reference is made to Japanese Unexamined Patent Application Publication No. 2016-99468, for example.

SUMMARY

Reducing the magnitude of a current in a display unit to suppress an increase in electric power consumption may possibly decrease luminance of the display unit. A larger decrease in luminance may possibly cause adverse effects on display quality.

It is desirable to provide a luminance controlling unit, a light-emitting unit, and a method of controlling luminance that are able to minimize adverse effects on display quality while suppressing an increase in electric power consumption.

A luminance controlling unit according to one embodiment of the disclosure includes a luminance controller that controls luminance of a pixel array including pixels each including a current-driven self-luminescent element. The luminescent controller sets, on the basis of an image signal corresponding to a frame image, a threshold that is directed to detection of a maximum signal level of the image signal, and performs dynamic control of a potential difference between a first voltage and a second voltage on the basis of the maximum signal level detected with reference to the set threshold. The first voltage is outputted from a first voltage source adjacent to an anode of the self-luminescent element, and the second voltage is outputted from a second voltage source adjacent to a cathode of the self-luminescent element.

A luminance controlling unit according to one embodiment of the disclosure includes a luminance controller that controls luminance of a pixel array including pixels each including a current-driven self-luminescent element. The luminance controller corrects a histogram distribution of an image signal corresponding to a frame image on a basis of a line-of-sight position of a viewer or a viewing-listening distance of the viewer, and performs dynamic control of a potential difference between a first voltage and a second voltage on a basis of a maximum signal level of the image signal. The first voltage is outputted from a first voltage source adjacent to an anode of the self-luminescent element, and the second voltage is outputted from a second voltage source adjacent to a cathode of the self-luminescent element. The maximum signal level is detected on a basis of the corrected histogram distribution.

A light-emitting unit according to one embodiment of the disclosure includes a pixel array that includes pixels each including a current-driven self-luminescent element, and a luminance controller that controls luminance of the pixel array. The luminance controller sets, on a basis of an image signal corresponding to a frame image, a threshold that is directed to detection of a maximum signal level of the image signal, and performs dynamic control of a potential difference between a first voltage and a second voltage on a basis of the maximum signal level detected with reference to the set threshold. The first voltage is outputted from a first voltage source adjacent to an anode of the self-luminescent element, and the second voltage is outputted from a second voltage source adjacent to a cathode of the self-luminescent element.

A light-emitting unit includes a pixel array that includes pixels each including a current-driven self-luminescent element, and a luminance controller that controls luminance of the pixel array. The luminance controller corrects a histogram distribution of an image signal corresponding to a frame image on a basis of a line-of-sight position of a viewer or a viewing-listening distance of the viewer, and performs dynamic control of a potential difference between a first voltage and a second voltage on a basis of a maximum signal level of the image signal. The first voltage is outputted from a first voltage source adjacent to an anode of the self-luminescent element, and the second voltage is outputted from a second voltage source adjacent to a cathode of the self-luminescent element. The maximum signal level is detected on a basis of the corrected histogram distribution.

A method of controlling luminance according to one embodiment of the disclosure controls luminance of a pixel array that includes pixels each including a current-driven self-luminescent element. The method includes setting, on a basis of an image signal corresponding to a frame image, a threshold that is directed to detection of a maximum signal level of the image signal, and dynamically controlling a potential difference between a first voltage and a second voltage on a basis of the maximum signal level detected with reference to the set threshold. The first voltage is outputted from a first voltage source adjacent to an anode of the self-luminescent element, and the second voltage is outputted from a second voltage source adjacent to a cathode of the self-luminescent element.

A method of controlling luminance according to one embodiment of the disclosure controls luminance of a pixel array that includes pixels each including a current-driven self-luminescent element. The method includes correcting a histogram distribution of an image signal corresponding to a frame image on a basis of a line-of-sight position of a viewer or a viewing-listening distance of the viewer, and dynamically controlling a potential difference between a first voltage and a second voltage on a basis of a maximum signal level of the image signal. The first voltage is outputted from a first voltage source adjacent to anode of the self-luminescent element, and the second voltage is outputted from the second voltage source adjacent to a cathode of the self-luminescent element. The maximum signal level is detected on a basis of the corrected histogram distribution.

BRIEF DESCRIPTION OF THE DRAWINGS

The accompanying drawings are included to provide a further understanding of the disclosure and are incorporated in and constitute a part of this specification. The drawings illustrate exemplary embodiments and, together with the specification, serve to explain the principles of the disclosure.

DETAILED DESCRIPTION

Figure 1:
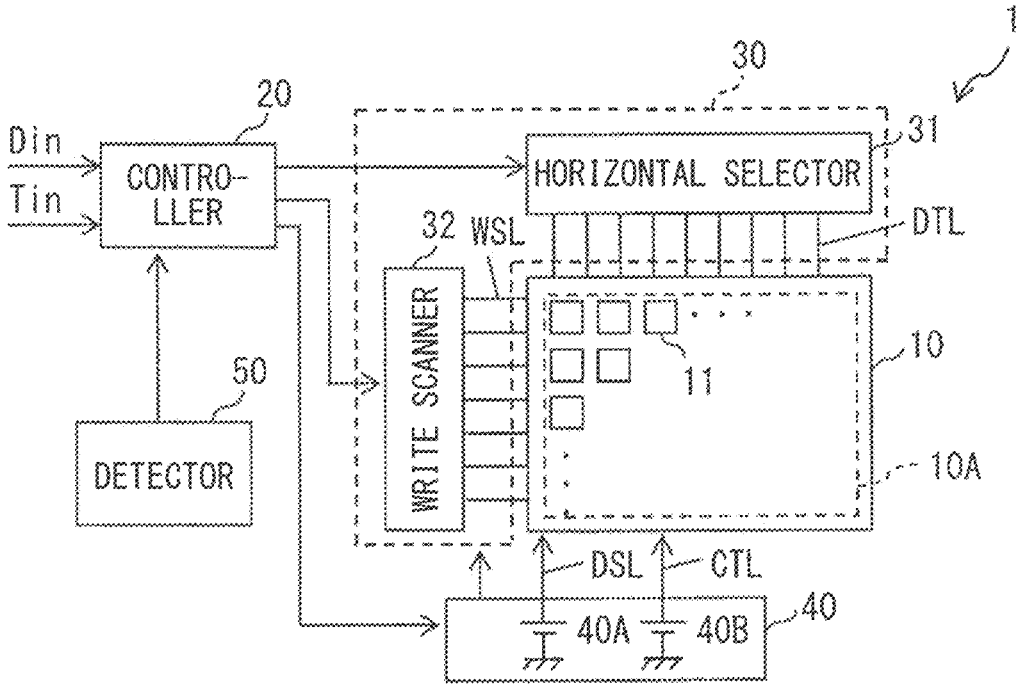
FIG. 1 schematically illustrates an exemplary configuration of a display unit according to one embodiment of the disclosure.
Figure 2:
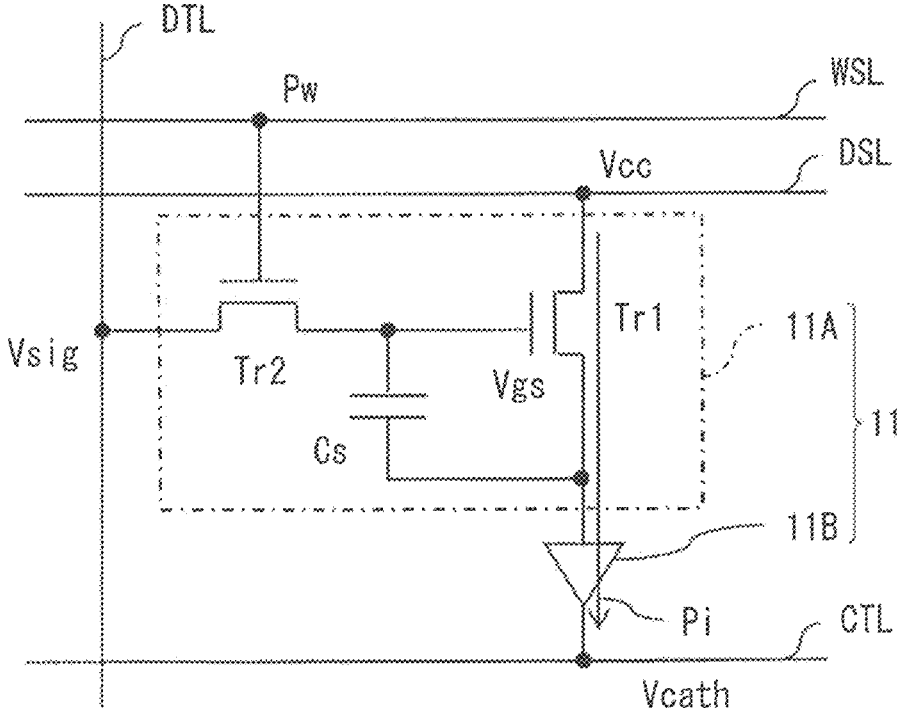
FIG. 2 is an exemplary circuit configuration of each pixel according to one embodiment of the disclosure.

In the following, some exemplary embodiments of the disclosure are described in detail, in the following order, with reference to the accompanying drawings. Note that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following exemplary embodiments which are not recited in a most-generic independent claim of the disclosure are optional and may be provided on an as-needed basis. The drawings are schematic and are not intended to be drawn to scale. Note that the like elements are denoted with the same reference numerals, and any redundant description thereof will not be described in detail. Note that the description is given in the following order.

1. Embodiments
2. Modification Examples

1. EMBODIMENTS

[Configuration]

FIG. 1 schematically illustrates an exemplary configuration of a display unit 1 according to an exemplary embodiment of the disclosure. The display unit 1 may include, for example, a display panel 10, a controller 20, a driver 30, a power supply circuit 40, and detector 50. The display unit 1 may correspond to a specific but non-limiting example of a "light-emitting unit" according to one embodiment of the disclosure. The controller 20 may correspond to a specific but non-limiting example of a "luminance controller" according to one embodiment of the disclosure. The driver 30 may be mounted on an outer edge of the display panel 10, for example. The controller 20 and the power supply circuit 40 may be mounted on a substrate that is coupled to the display panel 10 via flexible printed circuits (FPCs), for example.

The display panel 10 may include a pixel array 10A including multiple pixels 11 arranged in matrix. The controller 20 and the driver 30 may drive the display panel 10 (i.e., pixels 11) on the basis of an external image signal Din and an external synchronizing signal Tin. The power supply circuit 40 may supply a predetermined voltage to the driver 30 and the display panel 10.

[Display Panel 10]

In response to the active-matrix driving of the pixels 11 performed by the controller 20 and the driver 30, the display panel 10 may display an image based on the external image signal Din and the external synchronizing signal Tin. The display panel 10 may include multiple scanning lines WSL extending in a row direction, multiple signal lines DTL extending in a column direction, multiple power lines DSL, multiple cathode lines CTL, and the multiple pixels 11 arranged in matrix. In place of the multiple cathode lines CTL, a cathode sheet may be provided over the pixel array 10A. Note that the term "cathode lines CTL" may be used interchangeably with the term "cathode sheet" in the following description.

The scanning lines WSL may be used to select the pixels 11. For example, a selection pulse Pw may be supplied through the scanning lines WSL to the pixels 11 to select the pixels 11 on a predetermined unit basis. The pixels 11 may be selected on a pixel-row basis, for example. A signal voltage Vsig based on the image signal Din may be supplied through the signal lines DTL to to the pixels 11. The signal lines DTL may be each coupled to an output end of a horizontal selector 31 described below. Each of the signal lines DTL may be assigned to its corresponding pixel column, for example. The scanning lines WSL may be each coupled to an output end of a write scanner 32 described below. Each of the scanning lines WSL may be assigned to its corresponding pixel row, for example.

The power lines DSL and the cathode lines CTL may be used to supply, to the pixels 11, a power voltage Vcc and a cathode voltage Vcath that are outputted from the power supply circuit 40, respectively. The power voltage Vcc may correspond to a specific but non-limiting example of a "first voltage" according to one embodiment of the disclosure, and the cathode voltage Vcath may correspond to a specific but non-limiting example of a "second voltage" according to one embodiment of the disclosure. The pixels 11 may correspond to organic electroluminescent elements 11B described below. The power lines DSL and the cathode lines CTL may be each coupled to an output end of the power supply circuit 40.

The pixels 11 on the pixel array 10A may include ones emitting red light, ones emitting green light, and ones emitting blue light, for example. The pixels 11 may further include ones emitting light in another color, such as white or yellow, for example.

The pixels 11 each include, for example, a pixel circuit 11A and an organic electroluminescent element 11B. The organic electroluminescent element 11B is a current-driven self-luminescent element.

The pixel circuit 11A may control light emission and light extinction of the organic electroluminescent element 11B. The pixel circuit 11A may hold a voltage written into its corresponding pixel 11 through write scanning described below. The pixel circuit 11A may include a driving transistor Tr1, a switching transistor Tr2, and a storage capacitor Cs.

The switching transistor Tr2 may control application of the signal voltage Vsig to a gate of the driving transistor Tr1. The signal voltage Vsig may be based on the image signal Din. For example, the switching transistor Tr2 may sample a voltage of the signal line DTL and write the sampled voltage into the gate of the driving transistor Tr1. Through the sampling of the signal voltage Vsig of the signal line DTL, the switching transistor Tr2 may generate a data pulse Pd having the signal voltage Vsig as a peak value and apply the data pulse Pd to the gate of the driving transistor Tr1.

The driving transistor Tr1 may be coupled in series to the organic electroluminescent element 11B. The driving transistor Tr1 may drive the organic electroluminescent element 11B. The driving transistor Tr1 may control a driving current flowing in the organic electroluminescent element 11B on the basis of the magnitude of the voltage sampled at the switching transistor Tr2. The storage capacitor Cs may hold a predetermined voltage between the gate and a source of the driving transistor Tr1. The storage capacitor Cs may hold a gate-source voltage Vgs of the driving transistor Tr1 at a constant level for a predetermined period. Note that the pixel circuit 11A may have a circuit configuration that includes the 2Tr1C circuit described above and additional capacitors and transistors. Alternatively, the pixel circuit 11A may have a circuit configuration different from that of the 2Tr1C circuit described above.

Each of the signal lines DTL may be coupled to an output end of the horizontal selector 31 described below and a source or drain of the switching transistor Tr2. Each of the scanning lines WSL may be coupled to an output end of the write scanner 32 described below and a gate of the switching transistor Tr2. Each of the power lines DSL may be coupled to an output end of a power supply circuit 40 and the source or drain of the driving transistor Tr1. Each of the cathode lines CTL may be coupled to the output end of the power supply circuit 40 and a cathode of the organic electroluminescent element 11B.

The gate of the switching transistor Tr2 may be coupled to its corresponding scanning line WSL. One of the source or drain of the switching transistor Tr2 may be coupled to its corresponding signal line DTL. The other of the source or drain, of the switching transistor Tr2, that is not coupled to the signal line DTL may be coupled to the gate of the driving transistor Tr1. One of the source or drain of the driving transistor Tr1 may be coupled to its corresponding power line DSL. The other of the source or drain, of the driving transistor Tr1, that is not coupled to the power line DSL may be coupled to an anode of the organic electroluminescent element 11B. One end of the storage capacitor Cs may be coupled to the gate of the driving transistor Tr1. The other end of the storage capacitor Cs may be coupled to one of the source or drain, of the driving transistor Tr1, that is adjacent to the organic electroluminescent element 11B. The cathode of the organic electroluminescent element 11B may be coupled to its corresponding cathode line CTL.

[Driver 30]

The driver 30 may include the horizontal selector 31 and the write scanner 32, for example. The horizontal selector 31 may apply the analog signal voltage Vsig to each of the signal lines DTL, in response to a control signal from the controller 20, for example. The write scanner 32 may apply the analog selection pulse Pw to each of the scanning lines WSL, in response to a control signal from the controller 20, for example. The horizontal selector 31 and the write scanner 32 may apply the signal voltage Vsig through the signal line DTL to the source or drain of the switching transistor Tr2, and apply the selection pulse Pw through the scanning line WSL to the gate of the switching transistor Tr2. The data pulse having a peak value of the signal voltage Vsig may be thereby written into the gate of the driving transistor Tr1.

[Power Supply Circuit 40]

The power supply circuit 40 may apply the power voltage Vcc and the cathode voltage Vcath to each pixel. The power supply circuit 40 may apply a potential difference ΔV (=Vcc−Vcath) to each pixel. For example, the power supply circuit 40 may supply the potential difference ΔV (=Vcc−Vcath) to a current path Pi in each pixel. The current path Pi may include the driving transistor Tr1 and the organic electroluminescent element 11B. The power supply circuit 40 may include, for example, voltage sources 40A and 40B. The voltage source 40A, which may correspond to a specific but non-limiting example of a "first voltage source" of one embodiment of the disclosure, may output the power voltage Vcc to the power line DSL. The voltage source 40B, which may correspond to a specific but non-limiting example of a "second voltage source" according to one embodiment of the disclosure, may output the voltage Vcath to the cathode line CTL. The voltage source 40A or 40B or both may be configured to change a voltage value in response to a control signal from the controller 20.

[Detector 50]

The detector 50 may detect one or both of a line-of-sight (viewing-listening line) of a user and a distance between the user and the display unit 1. For example, the line-of-sight and the distance between the user and the display unit 1 may be detected based on the user who looks to an image displayed on the display unit 1 or listens to a sound outputted from the display unit 1. The distance between the user and the display unit 1 may correspond to a specific but non-limiting example of a "viewing-listening distance" (E2) according to one embodiment of the disclosure. The detector 50 may determine a position coordinate of the viewing-listening line in a frame image on the basis of the detected viewing-listening line. The position coordinate may correspond to a specific but non-limiting example of a "line-of-sight position" (E1) according to one embodiment of the disclosure. The line-of-sight position E1 may be, for example, image data including data items for the respective pixels 11, as with the frame image. For example, the pixels 11 corresponding to the position coordinate may be assigned with 1, and the other pixels 11 may be assigned with 0, in the image data.

[Controller 20]

Figure 3:
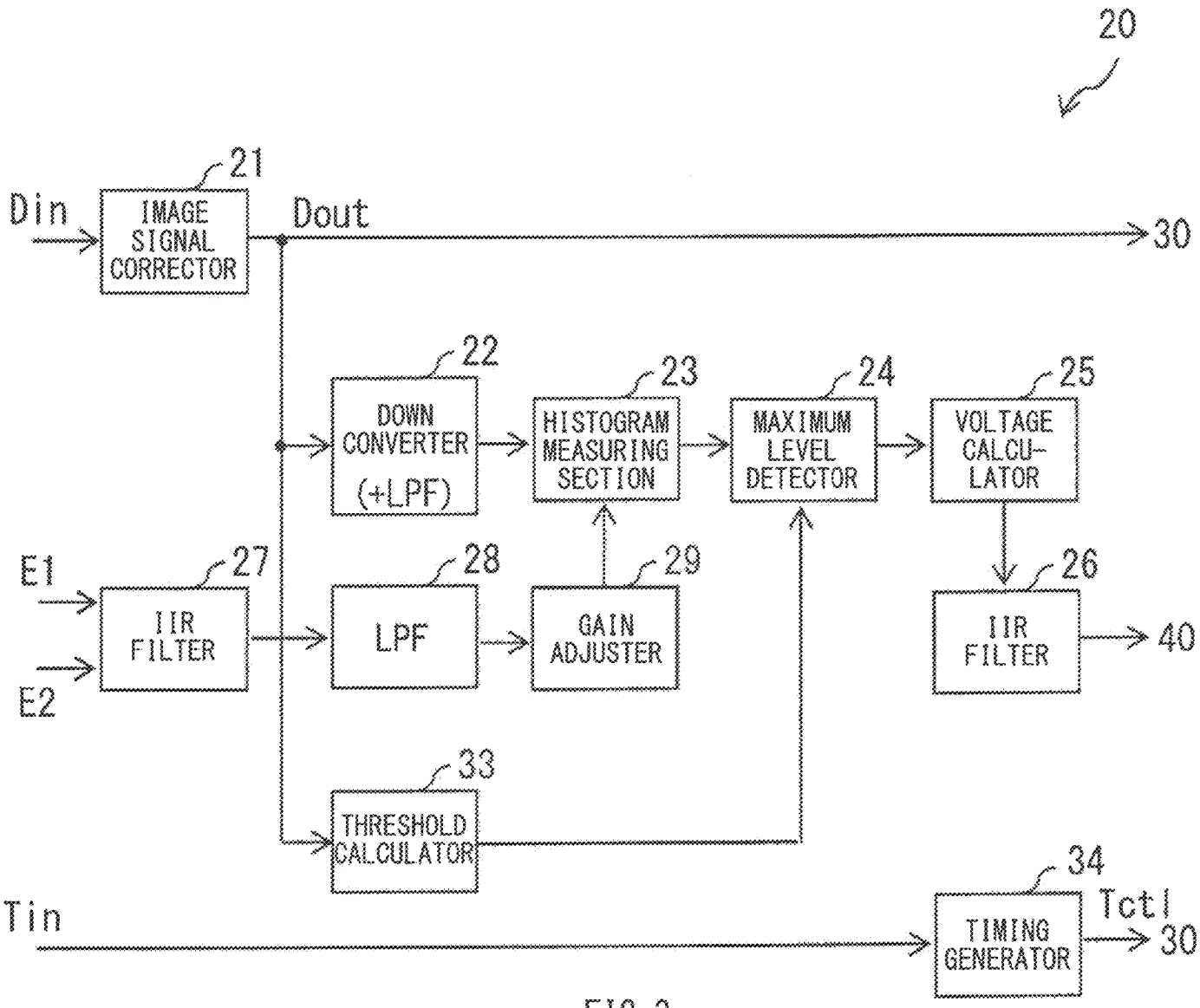
FIG. 3 is a block diagram illustrating an exemplary operation of a controller according to one embodiment of the disclosure.

The controller 20 will now be described. FIG. 3 is a block diagram illustrating an exemplary operation of the controller 20. The controller 20 controls luminance of the pixel array 10A. The controller 20 sets a threshold nth that is directed to detection of a maximum signal level (maximum gradation Cmax) of the image signal Din, on the basis of the image signal Din corresponding to the frame image. The controller 20 also performs dynamic control of the potential difference ΔV between the power voltage Vcc, outputted from the voltage source 40A adjacent to the anode of the organic electroluminescent element 11B, and the cathode voltage Vcath, outputted from the voltage source 40B adjacent to the cathode of the organic electroluminescent element 11B, on the basis of the maximum gradation Cmax detected with reference to the threshold nth.

The controller 20 may include, for example, an image signal corrector 21, a down converter 22, a histogram measuring section 23, a maximum level detector 24, a voltage calculator 25, IIR filters 26 and 27, a low-pass filter (LPF) 28, a gain adjuster 29, a threshold calculator 33, and a timing generator 34.

The image signal corrector 21 may perform predetermined image processing on the digital image signal Din received from an external device, for example, and output the processed image signal Dout to the horizontal selector 31 in the driver 30. For example, the image signal corrector 21 may collectively convert each combination of image signals Din representing different colors into a predetermined signal. The timing generator 34 may generate a control signal Tctl on the basis of the synchronizing signal Tin, and output the generated control signal Tctl to the horizontal selector 31 and the write scanner 32 in the driver 30.

Figure 4A:
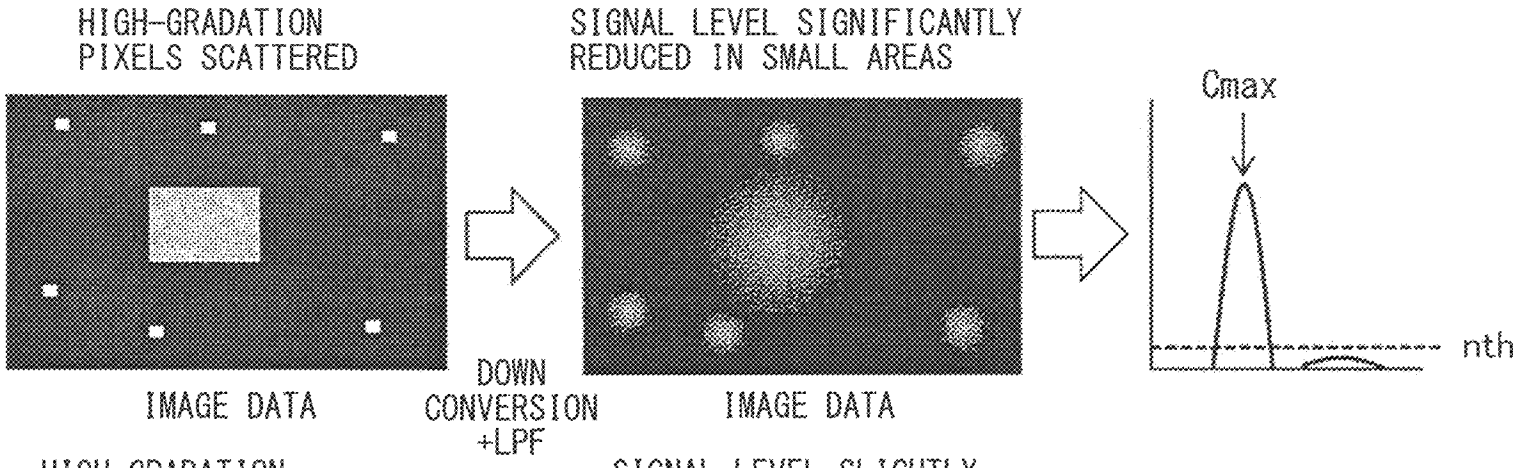
FIG. 4A illustrates an exemplary process performed by a down converter according to one embodiment of the disclosure.
Figure 4B:
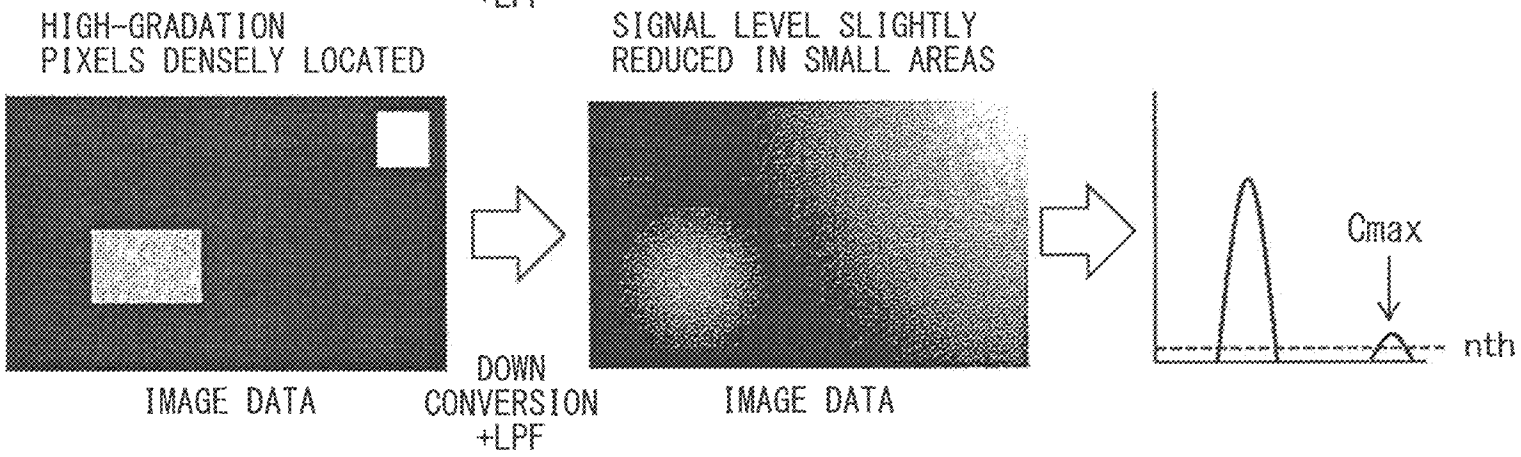
FIG. 4B illustrates another exemplary process performed by the down converter according to one embodiment of the disclosure.

In an exemplary embodiment, the down converter 22 may perform, on the image signal Dout, a down-conversion process and a low-pass filtering (LPF) process of eliminating spatial high-frequency fluctuations, to generate an image signal Da. In a case where the image signal Dout represents an image data in which multiple high-gradation pixels are scattered as illustrated in the left of FIG. 4A, the down converter 22 may perform, on the image signal Dout, the down-conversion process and the LPF process of eliminating the spatial high-frequency fluctuations, to generate the image signal Da in which the signal levels of the high-gradation pixels are significantly reduced, as illustrated in the middle of FIG. 4A. In another case where the image signal Dout represents an image data in which multiple high-gradation pixels are densely located as illustrated in the left of FIG. 4B, the down converter 22 may perform, on the image signal Dout, the down-conversion process and the LPF process of eliminating the spatial high-frequency fluctuations, to generate the image signal Da in which the signal levels of the high-gradation pixels are slightly reduced, as illustrated in the middle of FIG. 4B. The down converter 22 may output, for example, the generated image signal Da to the histogram measuring section 23.

Figure 5:
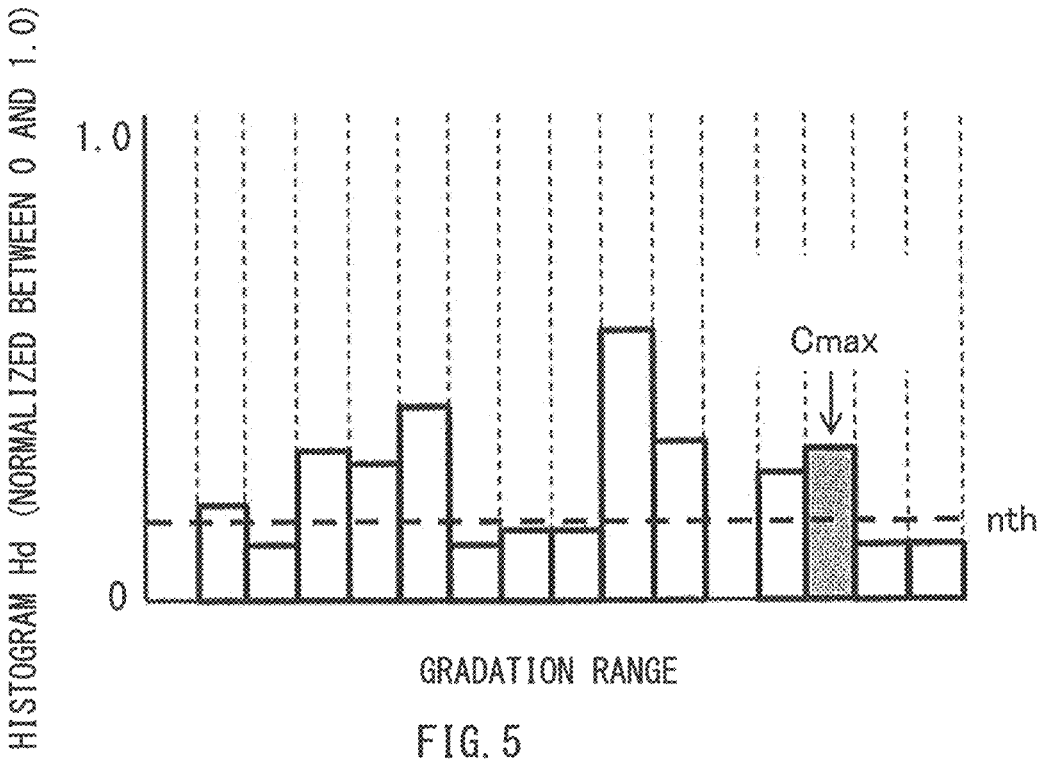
FIG. 5 illustrates exemplary histograms generated by a histogram measuring section according to one embodiment of the disclosure.

The histogram measuring section 23 may calculate the signal level of the image signal Da for each pixel 11, and generate histograms of the calculated signal levels of the respective pixels 11. Specific but non-limiting examples of the histograms generated by the histogram measuring section 23 may include ones illustrated in the right of FIG. 4A, the right of FIG. 4B, and FIG. 5. In FIG. 5, a horizontal axis represents the entire gradation that is divided into some ranges, and a vertical axis represents the n-number of the pixels 11 in each range. The n-number is normalized between 0 and 1.0, and hereinafter also referred to as a histogram Hd. The histogram measuring section 23 may output the generated histograms to the maximum level detector 24, for example.

Figure 6:
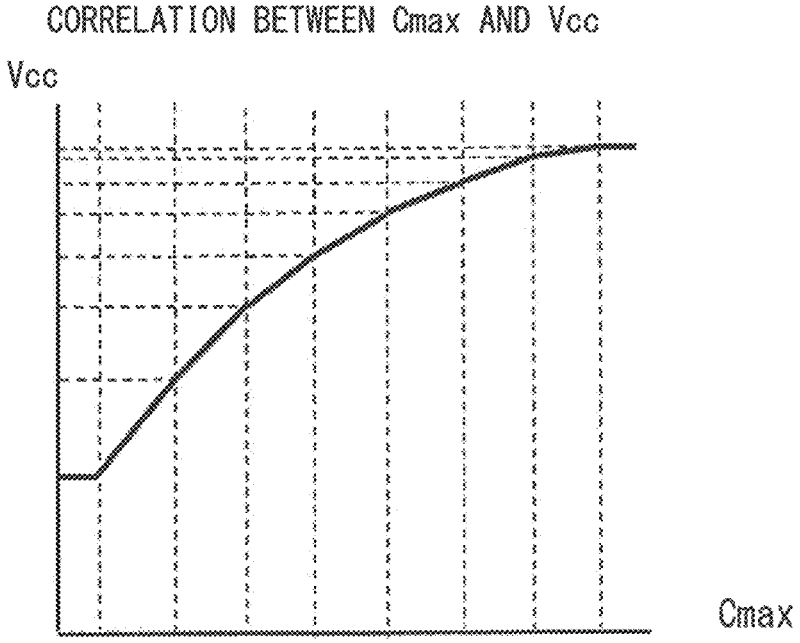
FIG. 6 illustrates an exemplary correlation between a maximum gradation and a power voltage according to one embodiment of the disclosure.

The maximum level detector 24 may compare the histograms generated at the histogram measuring section 23 with a threshold nth to detect a maximum maximum gradation Cmax. In other words, the threshold nth may be a variable that is directed to detection of a maximum level of the image signal Da. The threshold nth may be set by the threshold calculator 33 described below, for example. The maximum level detector 24 may hold a default value of the threshold nth, for example, and may change the threshold nth by multiplying the default value by a gain received from the threshold calculator 33. From some gradation ranges of the histograms Hd exceeding the threshold nth, the maximum level detector 24 may extract the highest gradation range (e.g., the gradation range of a shaded bar in FIG. 5) as the maximum gradation Cmax. The maximum level detector 24 may determine the power voltage Vcc based on the extracted maximum gradation Cmax. For example, the voltage calculator 25 may determine the power voltage Vcc based on the extracted maximum gradation Cmax using a table or mathematical function read from a memory thereof. The table or mathematical function may have a concept illustrated in FIG. 6, for example. FIG. 6 illustrates an exemplary correlation between the maximum gradation Cmax and the power voltage Vcc. The voltage calculator 25 may generate a control signal to set the power supply circuit 40 at the determined power voltage Vcc, and output the control signal to the IIR filter 26.

Figure 7:
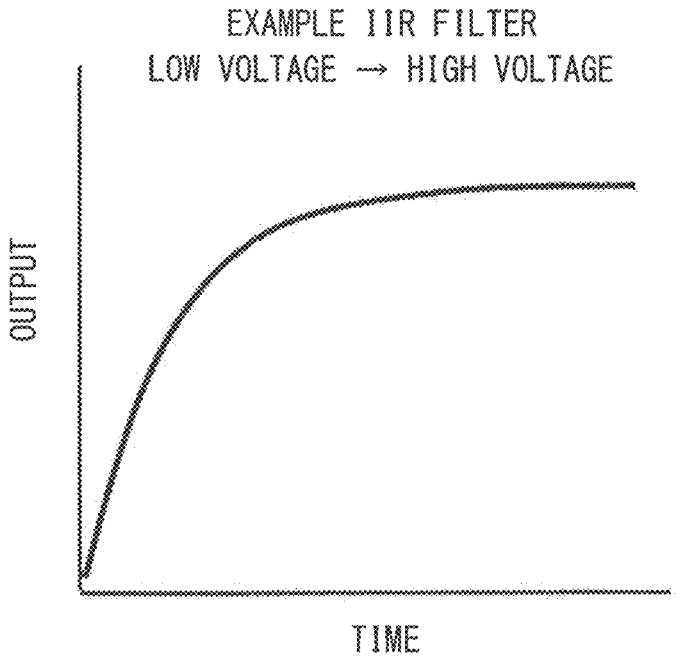
FIG. 7 illustrates an exemplary property of an infinite impulse response (IIR) filter according to one embodiment of the disclosure.
Figure 8:
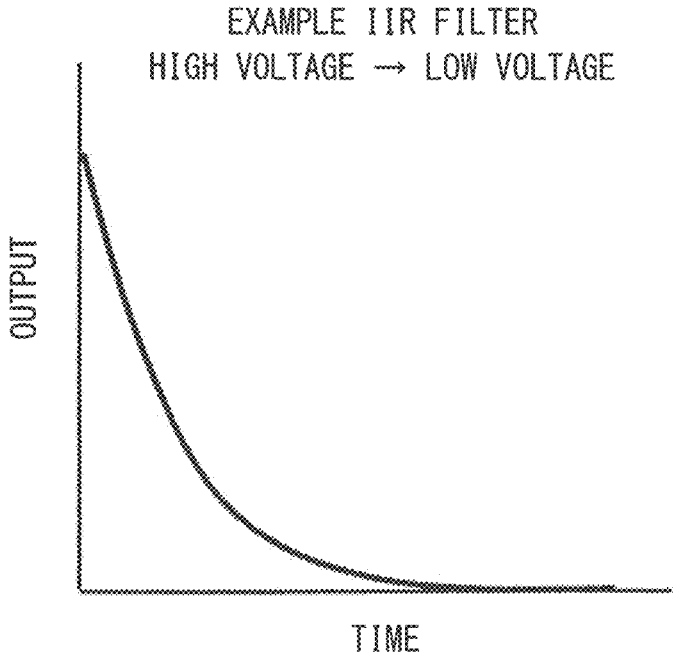
FIG. 8 illustrates another exemplary property of the IIR filter according to one embodiment of the disclosure.

The IIR filter 26 may perform, on the maximum gradation Cmax, a process of suppressing sharp temporal fluctuations. For example, the IIR filter 26 may perform, on the maximum gradation Cmax, a filtering process of suppressing sharp temporal fluctuation. The IIR filter 26 may be a filter that mitigates sharp temporal fluctuations of the control signal generated at the voltage calculator 25. In a case where the power voltage Vcc based on the control signal sharply increases, the IIR filter 26 may mitigate the sharp increase in the power voltage Vcc, as illustrated in FIG. 7, for example. In a case where the power voltage Vcc based on the control signal sharply decreases, the IIR filter 26 may mitigate the sharp decrease in the power voltage Vcc, as illustrated in FIG. 8, for example.

The IIR filter 27 may perform, on the line-of-sight position E1 determined at the detector 50, a process of suppressing sharp temporal fluctuations. For example, the IIR filter 27 may perform, on the line-of-sight position E1 detected at the detector 50, a filtering process of suppressing sharp temporal fluctuations. In a case where the line-of-sight position E1 sharply increases in value, the IIR filter 27 may mitigate the sharp increase in the value of the line-of-sight position E1, for example. In a case where the line-of-sight position E1 sharply decreases in value, the IIR filter 27 may mitigate the sharp decrease in the value of the line-of-sight position E1, for example. The LPF 28 may perform, on the signal (i.e., line-of-sight position E1) passing through the IIR filter 27, the LPF process of eliminating spatial high-frequency fluctuations.

Figure 9:
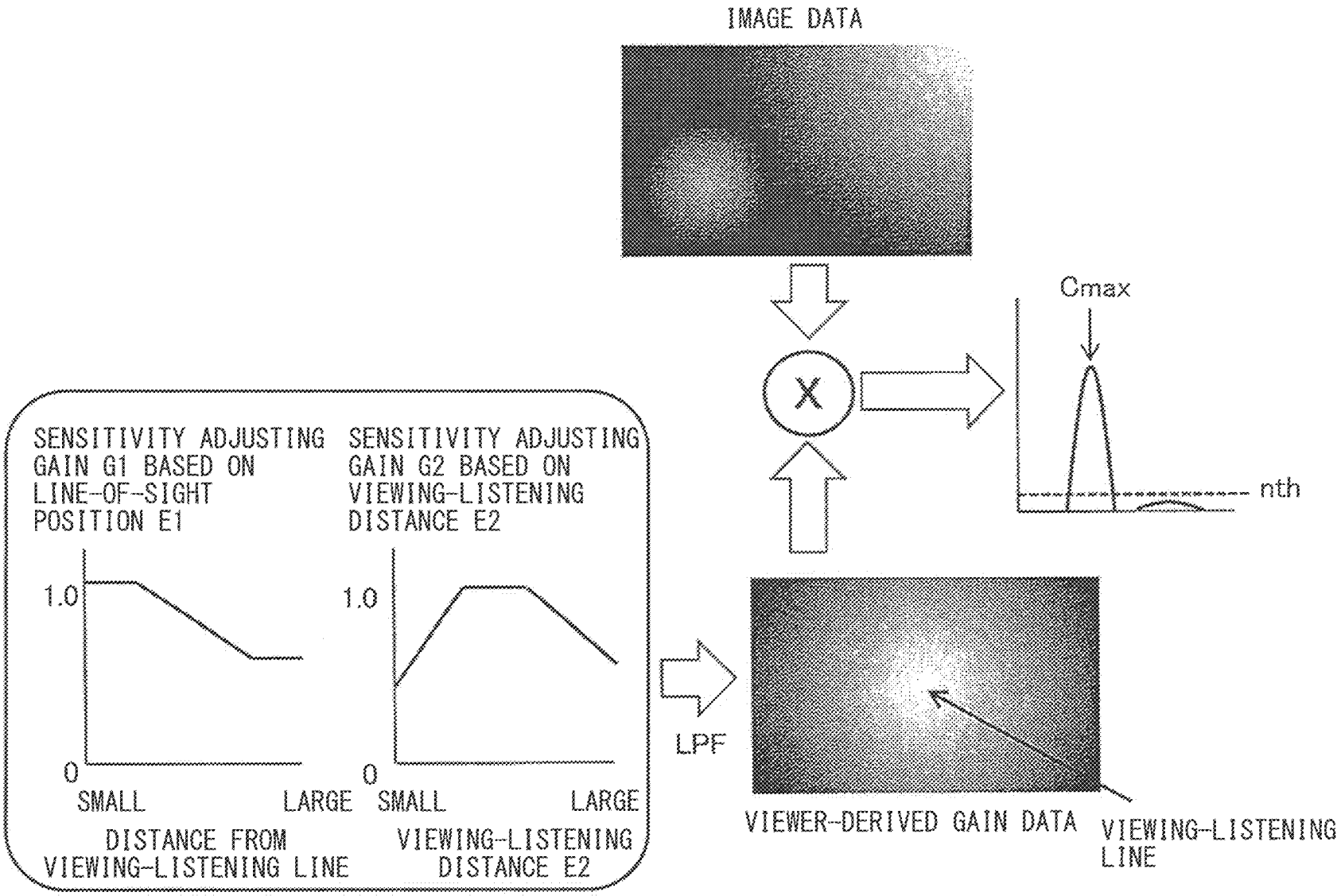
FIG. 9 illustrates an exemplary process performed by a gain adjuster according to one embodiment of the disclosure.

The gain adjuster 29 may multiply the resultant signal (i.e., line-of-sight position E1 obtained through the LPF process) by one or both of sensitivity adjusting gains G1 and G2, to correct the data regarding the line-of-sight position E1. For example, the gain adjuster 29 may multiply the line-of-sight position E1 by one or both of the sensitivity adjusting gains G1 and G2 illustrated in a box in the lower left of FIG. 9, for example, to correct the data regarding the line-of-sight position E1. The sensitivity adjusting gain G1 may decrease sensitivity in the frame image as the distance from the viewing-listening line becomes larger, for example. The sensitivity adjusting gain G2 may decrease sensitivity in the frame image when the viewing-listening distance E2 is small or large, whereas increase the sensitivity when the viewing-listening distance E2 is within an appropriate range, for example. The gain adjuster 29 may multiply the resultant signal (i.e., line-of-sight position E1 obtained through the LPF process) by one or both of the sensitivity adjusting gains G1 and G2, to generate image data illustrated in the lower right of FIG. 9, for example. The gain adjuster 29 may output, to the histogram measuring section 23, the generated image data as viewer-derived gain data.

The histogram measuring section 23 corrects the histogram distribution of the image signal Da on the basis of the signal obtained through the LPF process performed on the line-of-sight position E1 (i.e., on the basis of the line-of-sight position E1 after predetermined processing). For example, the histogram measuring section 23 may correct the histogram distribution of the image signal Da on the basis of the line-of-sight position E1 after the predetermined processing or the viewing-listening distance E2. The histogram measuring section 23 may further calculate the signal level of the corrected image signal Da for each pixel 11, and generate the histograms of the signal levels of the respective pixels 11. Through the correction process using the line-of-sight position E1 after the predetermined processing and the viewing-listening distance E2 described above, the histogram measuring section 23 may reduce the signal levels of some areas out of viewer's concern in the frame image, for example. Unlike the histogram in the right of FIG. 4B that has not been subjected to the correction process described above, the histogram Hd in the right of FIG. 9 that has been subjected to the correction process described above decreases and falls below the threshold nth in a high gradation range. This demonstrates that the correcting process described above allows the maximum gradation Cmax to be displaced to a lower value.

Figure 10A:
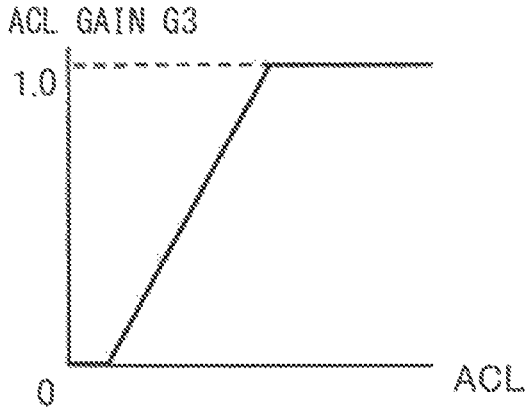
FIG. 10A illustrates an exemplary average current level (ACL) gain used at the threshold calculator according to one embodiment of the disclosure.
Figure 10B:
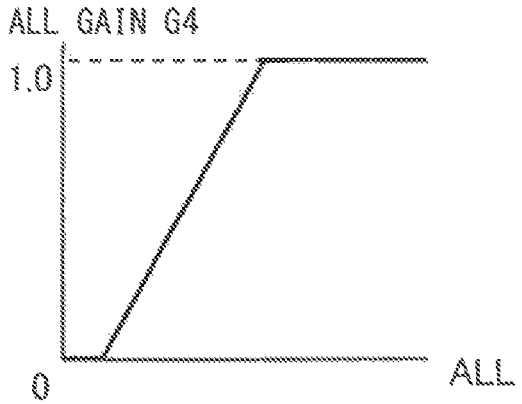
FIG. 10B illustrates an exemplary average luminance level (ALL) gain used at the threshold calculator according to one embodiment of the disclosure.
Figure 10C:
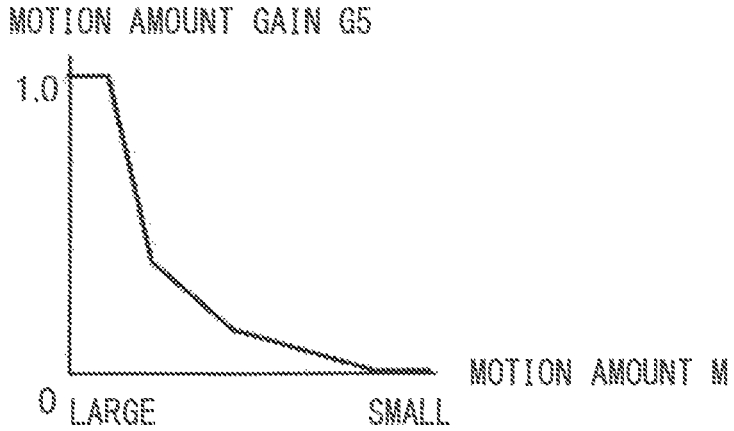
FIG. 10C illustrates an exemplary motion amount gain used at the threshold calculator according to one embodiment of the disclosure.

The threshold calculator 33 sets the threshold nth on the basis of an average luminance level L1 of the image signal Dout, an average current level L2 of the image signal Dout, or a motion amount M in the frame image. The threshold calculator 33 may hold, in a memory thereof, a gain G3 illustrated in FIG. 10A, a gain G4 illustrated in FIG. 10B, and a gain G5 illustrated in FIG. 10C, for example. The gain G3 may be based on an average current level (ACL) and hereinafter also referred to as ACL gain G3. The ACL gain G3 may increase with an increase in the ACL. The gain G4 may be based on an average luminance level (ALL) and hereinafter also referred to as ALL gain G4. The ALL gain G4 may increase with an increase in the ALL. The gain G5 may be based on a motion amount and hereinafter also referred to as motion amount gain G5. The motion amount gain G5 may decrease with a decrease in the motion amount.

Using the ACL gain G3 from the memory, for example, the threshold calculator 33 may determine a value of the ACL gain G3 to correct the threshold nth. For example, the threshold calculator 33 may calculate the average current level L2 from the image signal Dout, and determine a value of the ACL gain G3 based on the calculated average current level L2. Using the ALL gain G4 from the memory, for example, the threshold calculator 33 may determine a value of the ALL gain G4 to correct the threshold nth. For example, the threshold calculator 33 may calculate the average luminance level L1 from the image signal Dout, and determine a value of the ALL gain G4 based on the calculated average luminance level L1. Using the motion amount gain G5 from the memory, for example, the threshold calculator 33 may determine a value of the motion amount gain G5 to correct the threshold nth. For example, the threshold calculator 33 may calculate the motion amount M from the image signal Dout, and determine a value of the motion amount gain G5 based on the calculated motion amount M. The maximum level detector 24 may multiply the default threshold nth by one or more of the ACL gain G3, the ALL gain G4, and the motion amount gain G5 that are determined at the threshold calculator 33, to change the threshold nth.

[Effects]

Some effects of the display unit 1 according to any embodiment of the disclosure will now be described.

Reducing the magnitude of a current in the display unit including the pixels each including the self-luminescent element to suppress an increase in electric power consumption may possibly decrease luminance of the display unit. A larger decrease in luminance may possibly cause adverse effects on display quality.

In contrast, in any embodiment of the disclosure, the threshold nth directed to detection of the maximum signal level (maximum gradation Cmax) of the image signal Dout or Da is set on the basis of the image signal Dout or Da. Further, the potential difference ΔV between the power voltage Vcc, outputted from the voltage source 40A adjacent to the anode of the organic electroluminescent element 11B, and the cathode voltage Vcath, outputted from the voltage source 40B adjacent to the cathode of the organic electroluminescent element 11B, is dynamically controlled on the basis of the maximum gradation Cmax detected with reference to the set threshold nth. Accordingly, it is possible to minimize adverse effects on the display quality while suppressing an increase in electric power consumption.

In any embodiment of the disclosure, the histogram distribution of the image signal Dout or Da is corrected on the basis of the line-of-sight position E1 of a viewer or the viewing-listening distance E2 of the viewer. Further, the potential difference ΔV between the power voltage Vcc, outputted from the voltage source 40A adjacent to the anode of the organic electroluminescent element 11B, and the cathode voltage Vcath, outputted from the voltage source 40B adjacent to the cathode of the organic electroluminescent element 11B, is dynamically controlled on the basis of the maximum gradation Cmax of the image signal Dout or Da detected on the basis of the corrected histogram distribution. Accordingly, it is possible to minimize adverse effects on the display quality while suppressing an increase in electric power consumption.

In any embodiment of the disclosure, the threshold nth may be set on the basis of the average luminance level L1 of the image signal Dout, the average current level L2 of the image signal Dout, or the motion amount M in the frame image. This allows the threshold nth to be displaced to an appropriate value. Accordingly, it is possible to minimize adverse effects on the display quality while suppressing an increase in electric power consumption.

In any embodiment of the disclosure, the threshold nth may be set on the basis of the signal obtained through the down conversion process and the LPF process performed on the image signal Dout. This effectively reduces the luminance of small areas difficult to be perceived by the viewer, for example. Accordingly, it is possible to minimize adverse effects on the display quality while suppressing an increase in electric power consumption.

In any embodiment of the disclosure, the signal level of the image signal Dout may be calculated for each pixel 11, and the histograms of the calculated signal levels of the respective pixels 11 may be generated. The maximum signal level (maximum gradation Cmax) may be detected through the comparison between the generated histograms and the threshold nth. This detects the maximum signal level (maximum gradation Cmax) with accuracy. Accordingly, it is possible to minimize adverse effects on the display quality while suppressing an increase in electric power consumption.

In any embodiment of the disclosure, the potential difference ΔV may be dynamically controlled after the process of suppressing sharp temporal fluctuations on the maximum signal level (maximum gradation Cmax). For example, the maximum signal level (maximum gradation Cmax) may be subjected to the filtering process of suppressing sharp temporal fluctuations. This suppresses sharp fluctuations of the current flowing in the organic electroluminescent element 11B. Accordingly, it is possible to minimize adverse effects on the display quality while suppressing an increase in electric power consumption.

In any embodiment of the disclosure, the histogram distribution of the image signal Da may be corrected on the basis of the signal obtained through the LPF process performed on the line-of-sight position E1 (i.e., on the basis of the line-of-sight position E1 after predetermined processing). This effectively reduces the luminance of any area difficult to be perceived by the viewer, for example. Accordingly, it is possible to minimize adverse effects on the display quality while suppressing an increase in electric power consumption.

2. MODIFICATION EXAMPLES

Some modification examples of the display unit 1 according to any embodiment of the disclosure will now be described.

Figure 11:
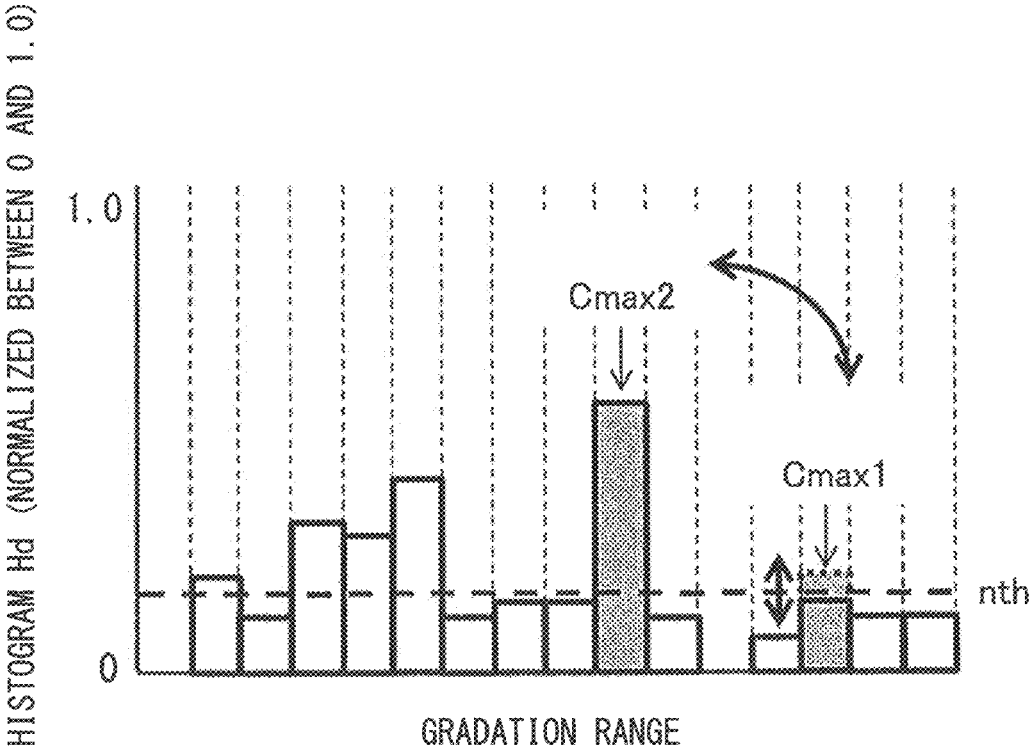
FIG. 11 illustrates exemplary histograms generated by the histogram measuring section according to one embodiment of the disclosure.

FIG. 11 illustrates exemplary histograms Hd generated by the histogram measuring section 23. As illustrated in FIG. 11, a histogram Hd may possibly fluctuate around the threshold nth (i.e., exceed and fall below the threshold nth) over time in a gradation range higher than the gradation range of the histogram Hd in which the maximum signal level (maximum gradation Cmax) is detected, in some cases. This may possibly cause temporal switching of the detected maximum signal level (maximum gradation Cmax) between two values, for example, between Cmax1 and Cmax2. Such a phenomenon may possibly cause adverse effects on the display quality. To address such a concern, in one modification example of the disclosure, the histogram measuring section 23 may perform a process of suppressing the switching. When a histogram Hd is around the threshold nth in a gradation range higher than the gradation range of the histogram Hd in which the maximum signal level (maximum gradation Cmax) is detected, the histogram measuring section 23 may correct the detected maximum signal level (maximum gradation Cmax) to a larger value within a gradation range not exceeding the higher gradation range.

Figure 12:
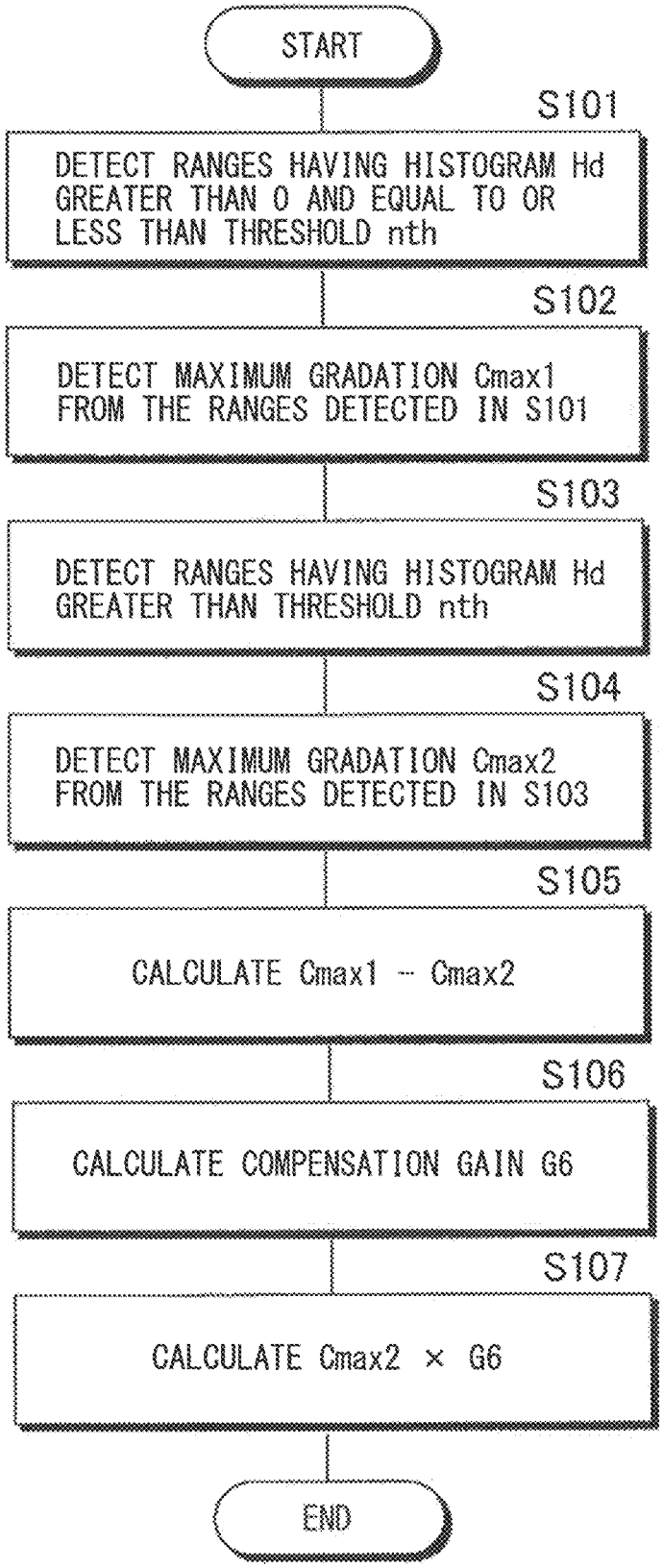
FIG. 12 is a flow chart of an exemplary process performed by the histogram measuring section according to one embodiment of the disclosure.

FIG. 12 is a flow chart of an exemplary process performed by the histogram measuring section 23 according to one modification example. The histogram measuring section 23 may first detect ranges having a histogram Hd greater than zero and equal to or less than the threshold nth (Step S101). The histogram measuring section 23 may thereafter detect a maximum signal level (maximum gradation Cmax1) from the ranges detected in Step S101 (Step S102). The histogram measuring section 23 may thereafter detect ranges having a histogram Hd greater than the threshold nth (Step S103). The histogram measuring section 23 may thereafter detect a maximum signal level (maximum gradation Cmax2) from the ranges detected in Step S103 (Step S104).

Figure 13:
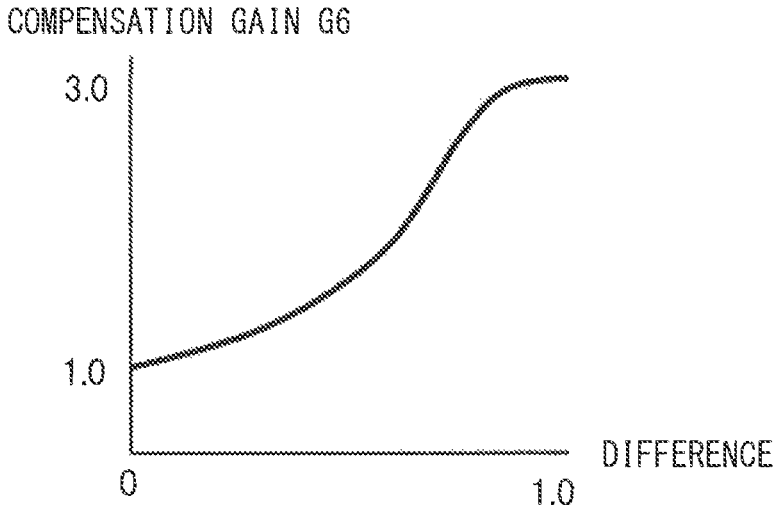
FIG. 13 illustrates an exemplary compensation gain used at the histogram measuring section according to one embodiment of the disclosure.

The histogram measuring section 23 may thereafter subtract the maximum gradation Cmax2 from the maximum gradation Cmax1 (i.e., Cmax1−Cmax2) (Step S105) to calculate a compensation gain G6 (Step S106). The compensation gain G6 may be correlated with the difference between the maximum gradations Cmax1 and Cmax2, as illustrated in FIG. 13, for example. The compensation gain G6 illustrated in FIG. 13 may increase with an increase in the difference between the maximum gradations Cmax1 and Cmax2. The histogram measuring section 23 may calculate the compensation gain G6 based on the difference between the maximum gradations Cmax1 and Cmax2, multiply the maximum gradation Cmax2 by the compensation gain G6 (i.e., Cmax2×G6), and set the resultant value as the maximum gradation Cmax (Step S107).

Such a correction of the maximum gradation Cmax suppresses the temporal switching of the detected maximum signal level (maximum gradation Cmax) between the two values, for example, the maximum gradations Cmax1 and Cmax2, due to the temporal fluctuations of the histogram Hd around the threshold nth (i.e., exceeding and falling below the threshold nth) in a gradation range higher than the gradation range of the histogram in which the detected maximum signal level (maximum gradation Cmax) is detected. Accordingly, it is possible to minimize adverse effects on the display quality while suppressing an increase in electric power consumption.

Note that effects described herein are merely illustrative. Effects of the disclosure are not intended to be limited to effects which are described herein. The disclosure may have other effects than those described herein.

Furthermore, the technology encompasses any possible combination of some or all of the various embodiments and the modifications described herein and incorporated herein. It is possible to achieve at least the following configurations from the above-described example embodiments of the technology.

Moreover, the disclosure may have the following configurations, for example.

(1) A luminance controlling unit including:

a luminance controller that controls luminance of a pixel array, the pixel array including pixels each including a current-driven self-luminescent element;

the luminance controller setting, on a basis of an image signal corresponding to a frame image, a threshold that is directed to detection of a maximum signal level of the image signal, and performing dynamic control of a potential difference between a first voltage and a second voltage on a basis of the maximum signal level detected with reference to the set threshold, the first voltage being outputted from a first voltage source adjacent to an anode of the self-luminescent element, the second voltage being outputted from a second voltage source adjacent to a cathode of the self-luminescent element.

(2) The luminance controlling unit according to (1), in which the luminance controller sets the threshold on a basis of a luminance level of the image signal, a current level of the image signal, or a motion amount in the frame image.

(3) The luminance controlling unit according to (1) or (2), in which the luminance controller detects the maximum signal level on a basis of a signal obtained through a down conversion process performed on the image signal.

(4) The luminance controlling unit according to any of (1) to (3), in which the luminance controller detects the maximum signal level through calculation of a signal level of the image signal for each of the pixels, generation of histograms of the calculated signal levels of the respective pixels, and a comparison between the generated histograms and the threshold.

(5) The luminance controlling unit according to any of (1) to (4), in which the luminance controller performs the dynamic control of the potential difference after performing, on the detected maximum signal level, a process of suppressing sharp temporal fluctuations.

(6) The luminance controlling unit according to (5), in which, when a histogram is around the threshold in a gradation range higher than a gradation range of the detected maximum signal level, the luminance controller corrects the detected maximum signal level to a larger value within a range not exceeding the higher gradation range.

(7) The luminance controlling unit according to (5), in which the luminance controller performs, on the detected maximum signal, a filtering process of suppressing the sharp temporal fluctuations.

(8) A luminance controlling unit including:

a luminance controller that controls luminance of a pixel array, the pixel array including pixels each including a current-driven self-luminescent element;

the luminance controller correcting a histogram distribution of an image signal corresponding to a frame image on a basis of a line-of-sight position of a viewer or a viewing-listening distance of the viewer, and performing dynamic control of a potential difference between a first voltage and a second voltage on a basis of a maximum signal level of the image signal, the first voltage being outputted from a first voltage source adjacent to an anode of the self-luminescent element, the second voltage being outputted from a second voltage source adjacent to a cathode of the self-luminescent element, the maximum signal level being detected on a basis of the corrected histogram distribution.

(9) The luminance controlling unit according to (8), in which the luminance controller corrects the histogram distribution of the image signal on a basis of a signal obtained through a low-pass filtering process performed on data regarding the line-of-sight position in the frame image.

(10) The luminescent controlling unit according to (8) or (9), in which the luminance controller calculates a signal level of the image signal for each of the pixels, generates histograms of the calculated signal levels of the respective pixels, and corrects the histogram distribution on a basis of the line-of-sight position or the viewing-listening distance.

(11) The luminance controlling unit according to any of (8) to (10), in which the luminance controller performs the dynamic control of the potential difference after performing, on the detected maximum signal level, a process of suppressing sharp temporal fluctuations.

(12) A light-emitting unit including:

a pixel array that includes pixels each including a current-driven self-luminescent element; and a luminance controller that controls luminance of the pixel array, the luminance controller setting, on a basis of an image signal corresponding to a frame image, a threshold that is directed to detection of a maximum signal level of the image signal, and performing dynamic control of a potential difference between a first voltage and a second voltage on a basis of the maximum signal level detected with reference to the set threshold, the first voltage being outputted from a first voltage source adjacent to an anode of the self-luminescent element, the second voltage being outputted from a second voltage source adjacent to a cathode of the self-luminescent element.

(13) A light-emitting unit including:

a pixel array that includes pixels each including a current-driven self-luminescent element; and a luminance controller that controls luminance of the pixel array, the luminance controller correcting a histogram distribution of an image signal corresponding to a frame image on a basis of a line-of-sight position of a viewer or a viewing-listening distance of the viewer, and performing dynamic control of a potential difference between a first voltage and a second voltage on a basis of a maximum signal level of the image signal, the first voltage being outputted from a first voltage source adjacent to an anode of the self-luminescent element, the second voltage being outputted from a second voltage source adjacent to a cathode of the self-luminescent element, the maximum signal level being detected on a basis of the corrected histogram distribution.

(14) A method of controlling luminance of a pixel array that includes pixels each including a current-driven self-luminescent element, the method including:

setting, on a basis of an image signal corresponding to a frame image, a threshold that is directed to detection of a maximum signal level of the image signal; and dynamically controlling a potential difference between a first voltage and a second voltage on a basis of the maximum signal level detected with reference to the set threshold, the first voltage being outputted from a first voltage source adjacent to an anode of the self-luminescent element, the second voltage being outputted from a second voltage source adjacent to a cathode of the self-luminescent element.

(15) A method of controlling luminance of a pixel array that includes pixels each including a current-driven self-luminescent element, the method including:

correcting a histogram distribution of an image signal corresponding to a frame image on a basis of a line-of-sight position of a viewer or a viewing-listening distance of the viewer; and dynamically controlling a potential difference between a first voltage and a second voltage on a basis of a maximum signal level of the image signal, the first voltage being outputted from a first voltage source adjacent to anode of the self-luminescent element, the second voltage being outputted from a second voltage source adjacent to a cathode of the self-luminescent element, the maximum signal level being detected on a basis of the corrected histogram distribution.

According to the luminance controlling unit, the light-emitting unit, and the method of controlling luminance of any embodiment of the disclosure, it is possible to minimize adverse effects on the display quality while suppressing an increase in electric power consumption.

It should be noted that the effect of the disclosure is not limited to what is described here but may include any effect described herein.

Although the disclosure has been described in terms of exemplary embodiments, it is not limited thereto. It should be appreciated that variations may be made in the described embodiments by persons skilled in the art without departing from the scope of the disclosure as defined by the following claims. Effects of the disclosure are not limited to those described hereinabove, and may be other effect than those described herein. The limitations in the claims are to be interpreted broadly based on the language employed in the claims and not limited to examples described in this specification or during the prosecution of the application, and the examples are to be construed as non-exclusive. For example, in this disclosure, the use of the terms first, second, etc. do not denote any order or importance, but rather the terms first, second, etc. are used to distinguish one element from another. Moreover, no element or component in this disclosure is intended to be dedicated to the public regardless of whether the element or component is explicitly recited in the following claims.

What is claimed is:

1. A luminance controlling unit comprising:

a luminance controller that controls luminance of a pixel array, the pixel array including pixels each including a current-driven self-luminescent element;

the luminance controller setting, on a basis of an image signal corresponding to a frame image, a threshold that is directed to detection of a maximum signal level of the image signal, and performing dynamic control of a potential difference between a first voltage and a second voltage on a basis of the maximum signal level detected with reference to the set threshold, the first voltage being outputted from a first voltage source adjacent to an anode of the self-luminescent element, the second voltage being outputted from a second voltage source adjacent to a cathode of the self-luminescent element.

2. The luminance controlling unit according to claim 1, wherein the luminance controller sets the threshold on a basis of a luminance level of the image signal, a current level of the image signal, or a motion amount in the frame image.

3. The luminance controlling unit according to claim 1, wherein the luminance controller detects the maximum signal level on a basis of a signal obtained through a down conversion process performed on the image signal.

4. The luminance controlling unit according to claim 1, wherein the luminance controller detects the maximum signal level through calculation of a signal level of the image signal for each of the pixels, generation of histograms of the calculated signal levels of the respective pixels, and a comparison between the generated histograms and the threshold.

5. The luminance controlling unit according to claim 1, wherein the luminance controller performs the dynamic control of the potential difference after performing, on the detected maximum signal level, a process of suppressing sharp temporal fluctuations.

6. The luminance controlling unit according to claim 5, wherein, when a histogram is around the threshold in a gradation range higher than a gradation range of the detected maximum signal level, the luminance controller corrects the detected maximum signal level to a larger value within a range not exceeding the higher gradation range.

7. The luminance controlling unit according to claim 5, wherein the luminance controller performs, on the detected maximum signal, a filtering process of suppressing the sharp temporal fluctuations.

8. A light-emitting unit comprising:

a pixel array that includes pixels each including a current-driven self-luminescent element; and a luminance controller that controls luminance of the pixel array, the luminance controller setting, on a basis of an image signal corresponding to a frame image, a threshold that is directed to detection of a maximum signal level of the image signal, and performing dynamic control of a potential difference between a first voltage and a second voltage on a basis of the maximum signal level detected with reference to the set threshold, the first voltage being outputted from a first voltage source adjacent to an anode of the self-luminescent element, the second voltage being outputted from a second voltage source adjacent to a cathode of the self-luminescent element.

9. The light-emitting unit according to claim 8, wherein the luminance controller sets the threshold on a basis of a luminance level of the image signal, a current level of the image signal, or a motion amount in the frame image.

10. The light-emitting unit according to claim 8, wherein the luminance controller detects the maximum signal level on a basis of a signal obtained through a down conversion process performed on the image signal.

11. The light-emitting unit according to claim 8, wherein the luminance controller detects the maximum signal level through calculation of a signal level of the image signal for each of the pixels, generation of histograms of the calculated signal levels of the respective pixels, and a comparison between the generated histograms and the threshold.

12. The light-emitting unit according to claim 8, wherein the luminance controller performs the dynamic control of the potential difference after performing, on the detected maximum signal level, a process of suppressing sharp temporal fluctuations.

13. The light-emitting unit according to claim 12, wherein, when a histogram is around the threshold in a gradation range higher than a gradation range of the detected maximum signal level, the luminance controller corrects the detected maximum signal level to a larger value within a range not exceeding the higher gradation range.

14. The light-emitting unit according to claim 12, wherein the luminance controller performs, on the detected maximum signal, a filtering process of suppressing the sharp temporal fluctuations.

15. A method of controlling luminance of a pixel array that includes pixels each including a current-driven self-luminescent element, the method comprising:

setting, on a basis of an image signal corresponding to a frame image, a threshold that is directed to detection of a maximum signal level of the image signal; and dynamically controlling a potential difference between a first voltage and a second voltage on a basis of the maximum signal level detected with reference to the set threshold, the first voltage being outputted from a first voltage source adjacent to an anode of the self-luminescent element, the second voltage being outputted from a second voltage source adjacent to a cathode of the self-luminescent element.

16. The method of controlling luminance according to claim 15, wherein the threshold is set on a basis of a luminance level of the image signal, a current level of the image signal, or a motion amount in the frame image.

17. The method of controlling luminance according to claim 15, wherein the maximum signal level is detected on a basis of a signal obtained through a down conversion process performed on the image signal.

18. The method of controlling luminance according to claim 15, wherein the maximum signal level is detected through calculation of a signal level of the image signal for each of the pixels, generation of histograms of the calculated signal levels of the respective pixels, and a comparison between the generated histograms and the threshold.

19. The method of controlling luminance according to claim 15, wherein the dynamic control of the potential difference is performed after performing, on the detected maximum signal level, a process of suppressing sharp temporal fluctuations.

* * * * *